US011684124B2

(12) United States Patent
Brown, III

(10) Patent No.: US 11,684,124 B2
(45) Date of Patent: Jun. 27, 2023

(54) ACCESSORY WEARABLE AROUND A BOOT SHAFT

(71) Applicant: Charles H. Brown, III, Dallas, TX (US)

(72) Inventor: Charles H. Brown, III, Dallas, TX (US)

( * ) Notice: Subject to any disclaimer, the term of this patent is extended or adjusted under 35 U.S.C. 154(b) by 42 days.

(21) Appl. No.: 17/031,508

(22) Filed: Sep. 24, 2020

(65) Prior Publication Data

US 2022/0087370 A1 Mar. 24, 2022

(51) Int. Cl.

| | |
|---|---|
| ***A41D 17/00*** | (2006.01) |
| ***A43C 19/00*** | (2006.01) |
| *A43B 3/24* | (2006.01) |

(52) U.S. Cl.

CPC ..... *A43C 19/00* (2013.01); *A41D 17/00* (2013.01); *A41D 17/005* (2013.01); *A43B 3/242* (2013.01)

(58) Field of Classification Search

CPC ..... A43C 19/00; A41D 17/00; A41D 17/005
See application file for complete search history.

(56) References Cited

U.S. PATENT DOCUMENTS

| | | | | | |
|---|---|---|---|---|---|
| 1,634,576 | A * | 7/1927 | Hogan | A41D 17/00 | 36/2 A |
| 1,704,688 | A * | 3/1929 | Valentine | A43B 3/04 | 36/7.3 |
| 2,848,825 | A * | 8/1958 | Dollar | A41D 1/06 | 36/1 |
| 4,361,912 | A * | 12/1982 | Arthur | A63B 69/004 | 36/114 |
| 5,501,022 | A * | 3/1996 | Cohn | A41D 17/00 | 36/100 |
| 6,477,788 | B1 * | 11/2002 | Chen | A43B 3/166 | 36/1.5 |
| 7,891,116 | B1 * | 2/2011 | Iglikov | A43B 23/0205 | 36/4 |
| 7,937,852 | B1 * | 5/2011 | Krehbiel | A41D 17/00 | 36/2 R |
| 8,474,062 | B2 * | 7/2013 | Taylor | A41D 17/00 | 2/22 |
| 8,683,715 | B1 * | 4/2014 | Cantrell | A43B 3/0031 | 36/2 R |
| 10,667,565 | B2 * | 6/2020 | Chaney | B32B 3/04 | |
| 11,013,290 | B2 * | 5/2021 | Villanueva | A43B 3/04 | |
| 2002/0112298 | A1 * | 8/2002 | Baird | A43D 3/1416 | 12/128 R |
| 2003/0097765 | A1 * | 5/2003 | Chen | A43B 3/166 | 36/2 R |
| 2005/0188561 | A1 * | 9/2005 | Fine | A41D 17/00 | 36/2 R |

(Continued)

*Primary Examiner* — Katharine G Kane
(74) *Attorney, Agent, or Firm* — Jeffrey L. Streets; Madan Law PLLC

(57) ABSTRACT

An accessory that is wearable around a boot or other high-top shoe includes a generally flat strap having a first side, a second side, a first end and a second end. A patch of hook material may be secured to the first side of the strap adjacent to the first end and a patch of loop material may be secured to the second side of the strap adjacent to the second end. The strap has a length sufficient to wrap around the shaft of a boot and reduce an effective circumference of the boot shaft with the patch of hook material in face-to-face engagement with the patch of loop material.

16 Claims, 3 Drawing Sheets

(56) References Cited

U.S. PATENT DOCUMENTS

2007/0175064 A1* 8/2007 Culton ..... A43C 11/1493 36/7.1 R
2009/0049710 A1* 2/2009 Barnett ..... A43B 3/04 36/50.1
2009/0083996 A1* 4/2009 Clancy ..... A43B 13/223 36/8.1
2009/0178304 A1* 7/2009 Bollard ..... A43B 5/0474 36/118.2
2009/0183299 A1* 7/2009 Conway ..... B65D 81/3897 283/56
2010/0031534 A1* 2/2010 Davis ..... A43B 11/00 36/105
2010/0229429 A1* 9/2010 Longuet ..... A43B 7/085 36/3 R
2011/0239487 A1* 10/2011 Renkes ..... A43B 3/20 36/136
2013/0133228 A1* 5/2013 Nugent ..... A43C 11/06 36/109
2013/0305561 A1* 11/2013 Clinton ..... A43C 19/00 36/1.5
2014/0223639 A1* 8/2014 Betrus ..... A43B 23/06 2/245
2015/0230556 A1* 8/2015 Simmons ..... A43B 3/242 36/136
2015/0296919 A1* 10/2015 Kingsley-Poole ..... A43B 7/12 12/142 EV
2015/0327622 A1* 11/2015 Chaigne ..... A43B 5/002 36/114
2016/0021955 A1* 1/2016 Rich ..... A41F 17/04 2/231
2018/0360166 A1* 12/2018 Lockwood ..... A41D 17/005
2019/0000678 A1* 1/2019 Lister ..... A41B 11/143
2019/0239593 A1* 8/2019 Willis ..... A43B 3/242
2019/0350305 A1* 11/2019 Kerr ..... A43B 1/10

* cited by examiner

ACCESSORY WEARABLE AROUND A BOOT SHAFT

BACKGROUND

The present disclosure relates to an accessory for use with footwear.

DESCRIPTION OF THE RELATED ART

Boots come in all sizes, circumferences, heights, finishes and styles for all genders. A top portion of a boot from the heel to the boot opening is referred to as a shaft. The size of a boot shaft can vary in circumference, height and shape.

Pants come in various unisex fits, such as wide-leg to skinny leg to ultra-skinny leg fit. To adhere with clothing trends, it is common for a person to wear their pant legs over boots. However, the fit of pants to be worn with a selected pair of boots may make it difficult to pull the pant leg over the boot. Furthermore, even if it is possible to pull the pant leg over the boot, the boot may press outward against the pant leg to reveal the bumpy outline of the boot shaft, pull strap, zipper or other feature of the boot. This bumpy outline is not aesthetically pleasing for the boot wearer.

SUMMARY OF THE DISCLOSURE

Some embodiments provide an accessory wearable around a boot. The accessory includes a generally flat strap having a first side, a second side, a first end and a second end. A patch of hook material may be secured to the first side of the strap adjacent to the first end and a patch of loop material may be secured to the second side of the strap adjacent to the second end. The strap has a length sufficient to wrap around the shaft of a boot and reduce an effective circumference of the boot shaft with the patch of hook material in face-to-face engagement with the patch of loop material.

Some embodiments provide a method of using the strap. A person may put on a pair of pants, pull the cuff of a pant leg of the pants up the person's leg, and insert a foot of the person into a boot. The shaft of the boot may then be folded smooth against the wearer's leg. This may be referred to as a "folded condition." The strap may then be wrapped around the folded shaft of the boot before fastening the strap securely around the folded shaft of the boot to hold the shaft of the boot in a folded condition. Finally, the cuff of the pant leg may be pulled down over the folded shaft of the boot and the fastened strap. Accordingly, the boot should not produce visible bulges or deformation of the pant leg. Rather, the pant leg should lay down smoothly over the boot and strap.

BRIEF DESCRIPTION OF THE DRAWINGS

The features and advantages of the embodiments will become more apparent from the detailed description set forth below when taken in conjunction with the drawings in which like reference numbers indicate identical or functionally similar elements.

DETAILED DESCRIPTION

Figure 1A:
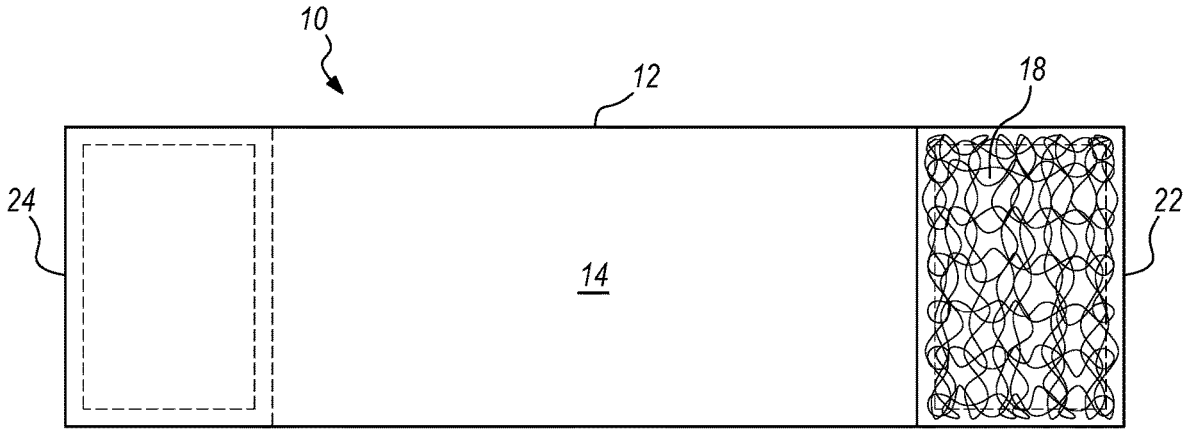
FIG. 1A is a top view of a strap with hook and loop fastener elements.

Some embodiments provide an accessory wearable around a boot or other high-top shoe. The accessory may be referred to as a "boot girdle." The accessory includes a generally flat strap having a first side, a second side, a first end and a second end. A patch of hook material may be secured to the first side of the strap adjacent to the first end and a patch of loop material may be secured to the second side of the strap adjacent to the second end. The strap has a length sufficient to wrap around the shaft of a boot and reduce an effective circumference of the boot shaft with the patch of hook material in face-to-face engagement with the patch of loop material.

The strap may be wrapped around the boot shaft to secure the boot shaft in a folded condition. For example, the folded condition of the boot shaft may fold the boot shaft about a vertical fold line. The strap preferably wraps around the boot shaft and presses the boot shaft against a leg of a person wearing the boot. It is beneficial for the strap to allow the leg of a pant to be pulled down over the boot and strap. A further benefit is that the strap may prevent the boot shaft from causing visible deformation of the pant leg. Accordingly, the appearance of the pant leg is more fashionable and tailored.

In some embodiments, the strap is elastic, such that the elastic strap may be stretched tightly about the folded boot shaft to hold it in position. Alternatively, the strap may be made with a fabric or leather, but other materials may also be used. One preferred material is 3 millimeter neoprene. Other suitable material may include, but are not limited to, cotton, canvas, denim, linen, plastic, nylon, and burlap. The strap may also be flexible and contour around the boot shaft and the calf area of the leg. In some embodiments, the strap may be made with a non-slip material, or include a non-slip material on the outer side of the strap, that will grip the pant leg material and keep it in place when walking or sitting down. With the use of such non-slip material, the pant leg will stay in place over the strap. One such non-slip material is a closed or open cell foam material.

The patch of hook material and the patch of loop material form a fastener that is both secure and easily manually removed. Such a fastener is commonly referred to as a hook and loop fastener. Hook and loop fasteners are available from various manufacturers, but are a well-known product of Velcro Companies. In one alternative, the patch of hook material and the patch of loop material may be replaced with a plurality of snap sockets and a plurality of snap studs, respectively. Any such snaps may be made with plastic or metal.

In some embodiments, the strap may have a width between 2 and 4 inches and/or a length between 8 and 20 inches. However, this range of widths and lengths are not limitations, but may be some suitable dimensions for a common range of boot sizes. The width of a strap is preferably sufficiently wide to prevent the folded boot shaft from twisting out of the strap and forming unsightly bulges visible through the pant leg. The length of a strap is preferably long enough to extend around the circumference of a folded boot shaft and overlap the patch of hook material with the patch of loop material. The patch of loop material preferably extends substantially the entire width of the strap and the patch of hook material preferably extends substantially the entire width of the strap. The hook patch and loop patch may have the same dimension along the length of the strap or may have a different dimension along the length of the strap. In one non-limiting example, the patches may each extend about 3.25 inches along the length of the strap.

Some embodiments provide a method of using the strap. A person may put on a pair of pants, pull the cuff of a pant leg of the pants up the person's leg, and insert a foot of the person into a boot. The shaft of the boot may then be folded smooth against the wearer's leg. This may be referred to as a "folded condition." The strap may then be wrapped around the folded shaft of the boot before fastening the strap securely around the folded shaft of the boot to hold the shaft of the boot in a folded condition. Finally, the cuff of the pant leg may be pulled down over the folded shaft of the boot and the fastened strap. Accordingly, the boot should not produce visible bulges or deformation of the pant leg. Rather, the pant leg should lay down smoothly over the boot and strap.

The strap wrapped around the boot may have a first end and a second end, wherein the strap is fastened securely around the folded shaft of the boot by pressing a hook patch secured to the first end of the strap against a loop patch secured to the second end of the strap.

In one option, the strap is elastic. Therefore, wrapping the strap securely around the folded shaft of the boot may include stretching the elastic strap and pressing a hook patch secured to the first end of the strap against a loop patch secured to the second end of the strap with the strap in a stretched condition.

The accessory may provide a solution for any sized (cowboy) boot paired with any width of pant leg, and ultimately reducing the printing of the shaft of the boot on the exterior of the pants. The result is an aesthetically uncompromised pant leg with a reduced outline or printing of the boot shaft which the pant leg is covering. This is accomplished by slimming the effective circumference of the boots to be worn under pants.

Optionally, the strap may be made available in various sizes for use with different sizes of boots. In general, larger sizes of boots may require a longer strap or a greater amount of overlap of hook and loop patches. For example, a stereotypical cowboy boot would be wider in circumference than most boots. This wider circumference makes it difficult, if not impossible, to wear pant legs over the boot shaft without bunching or misshaping of the pant leg. The strap allows a person to wear boots with various shaft heights and circumferences while having a slim line look when worn under a pant leg. Most preferably, a person will wear a pair of straps, where each strap is worn about one of a pair of boots.

Figure 1B:
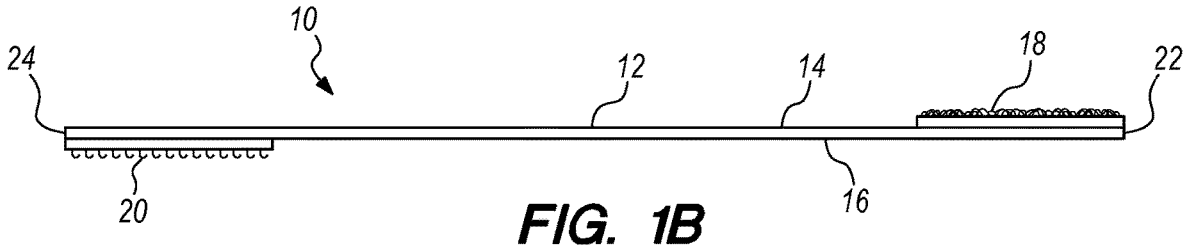
FIG. 1B is an edge view of the strap.
Figure 1C:
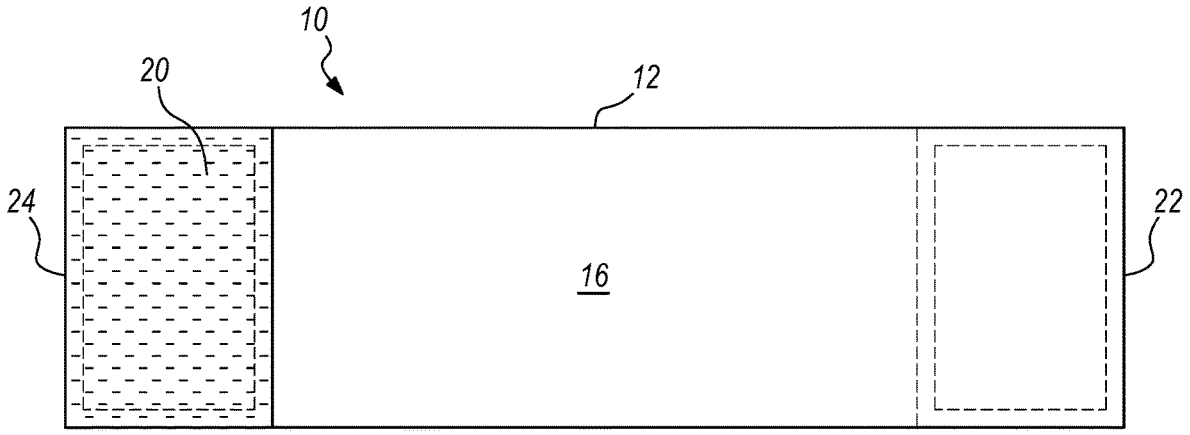
FIG. 1C is a bottom view of the strap.

FIG. 1A is a top view of an accessory 10 including a strap 12 and FIG. 1C is a bottom view of the accessory 10. The strap 12 is generally flat and has a first side 14 securing a patch of loop material 18 adjacent a first end 22. The loop material 18 may be adhered to the strap 10 in many ways, including adhesive, but is shown as having been stitched or sewn to the first side 14 of the underlying strap 12.

The generally flat strap 12 has a second side 16 shown in FIG. 1C securing a patch of hook material 20 adjacent a second end 24. The hook material 20 may be adhered to the strap 12 in many ways, including adhesive, but is shown as having been stitched or sewn to the second side 16 of the underlying strap 12.

FIG. 1B is an edge view of the strap 12 showing the patch of loop material 18 secured to the first side 14 of the strap 12 adjacent a first end 22 of the strap. The edge view also shows the patch of hook material 20 secured to the second side 16 of the strap 12 adjacent a second end 24 of the strap. The strap has a length sufficient to wrap around the shaft of a boot and reduce an effective circumference of the boot shaft with the patch of hook material in face-to-face engagement with the patch of loop material.

Figure 2A:
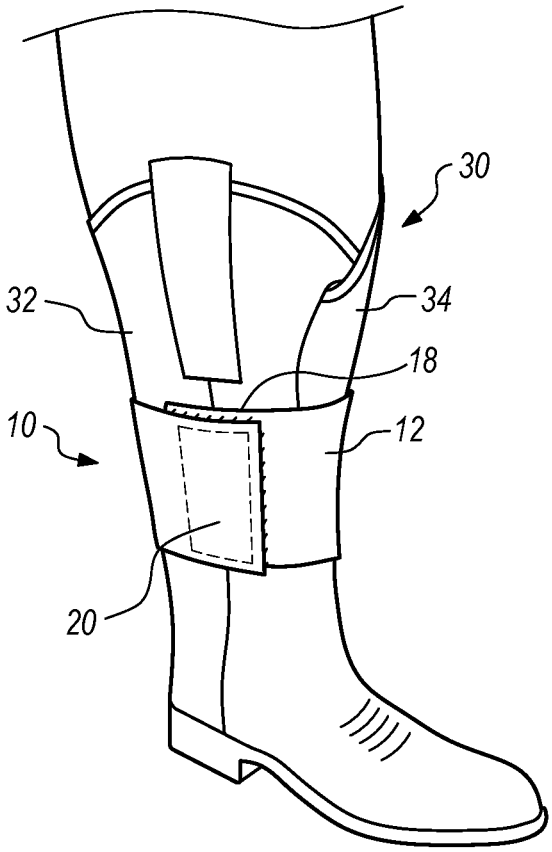
FIG. 2A is a perspective view of a boot with the strap secured in place around the boot.

FIG. 2A is a perspective view of a boot 30 with the accessory 10 secured in place around the boot 30. The boot 30 has a shaft 32 that has been folded (see fold 34) about a vertical fold line. The strap 12 wraps around the folded boot shaft 32, 34 and the patches of hook and loop materials 18, 20 are fully engaged and secured.

Figure 2B:
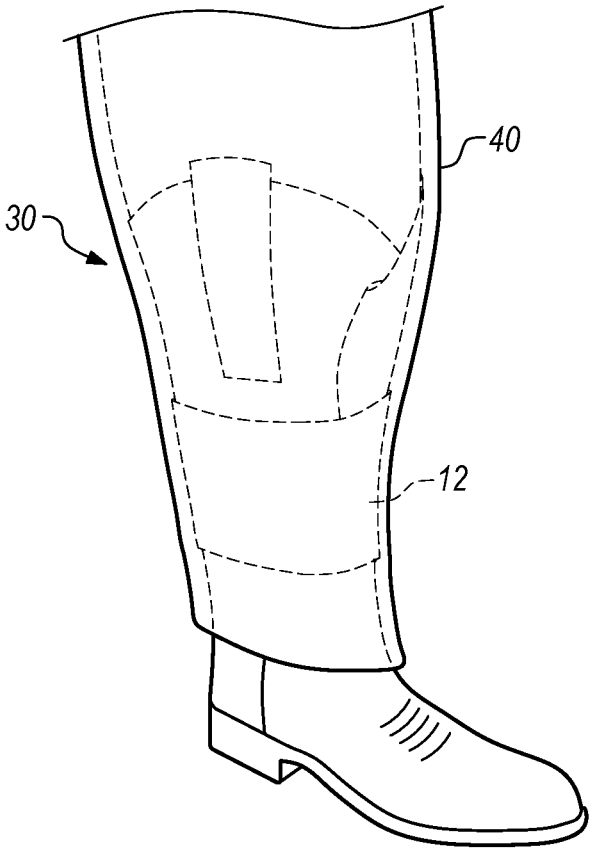
FIG. 2B is a perspective view of the boot of FIG. 2A with a pant leg pulled down around the boot with the strap.

FIG. 2B is a perspective view of the boot 30 of FIG. 2A with a pant leg 40 pulled down around the boot 30 with the strap 12. Notice the slimmed down appearance of the pant leg 40 about the boot folded down against the person's leg.

Figure 3A:
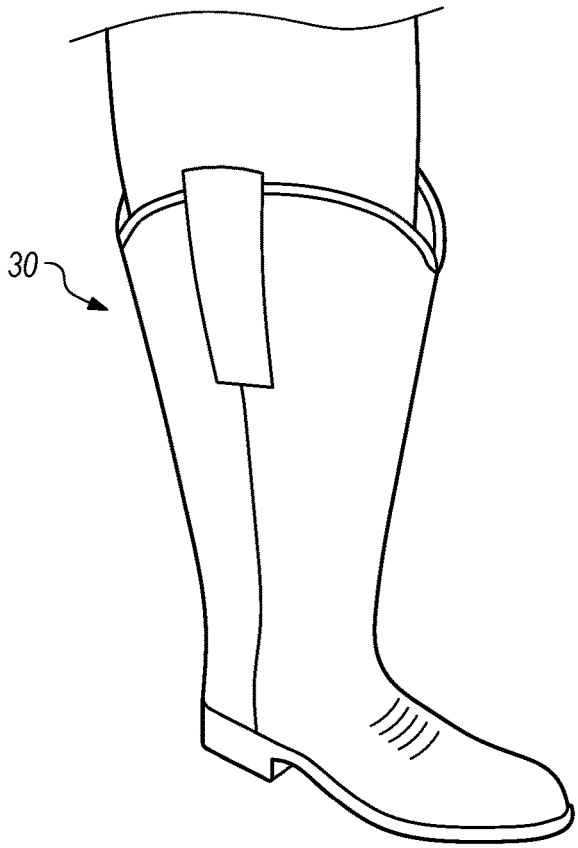
FIG. 3A is a perspective view of a boot without a strap.

FIG. 3A is a perspective view of the boot 30 without a strap.

Figure 3B:
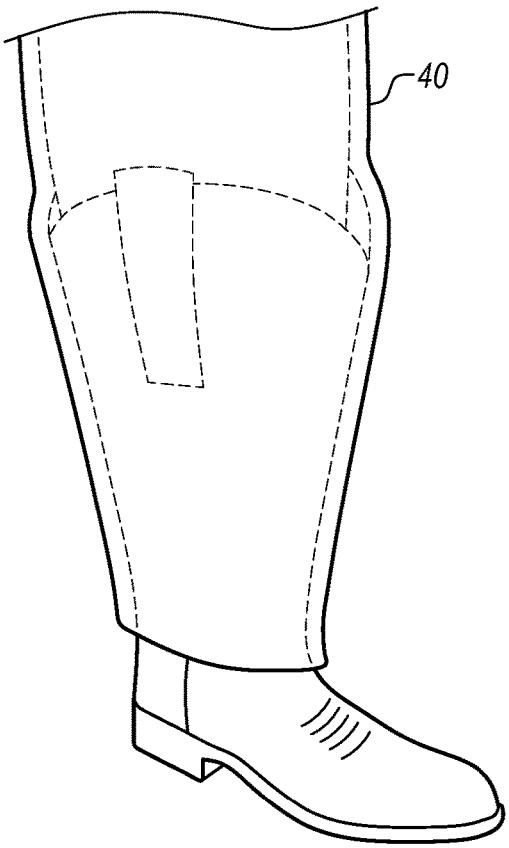
FIG. 3B is a perspective view of the boot of FIG. 3A without a strap with a pant leg pulled down around the boot shaft.

FIG. 3B is a perspective view of the boot 30 of FIG. 3A without a strap with a pant leg 40 pulled down around the boot. Notice the boot bulging outward and forming print or outline that is visible through the pant leg.

The terminology used herein is for the purpose of describing particular embodiments only and is not intended to limit the scope of the claims. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the embodiment.

The corresponding structures, materials, acts, and equivalents of all means or steps plus function elements in the claims below are intended to include any structure, material, or act for performing the function in combination with other claimed elements as specifically claimed. Embodiments have been presented for purposes of illustration and description, but it is not intended to be exhaustive or limited to the embodiments in the form disclosed. Many modifications and variations will be apparent to those of ordinary skill in the art after reading this disclosure. The disclosed embodiments were chosen and described as non-limiting examples to enable others of ordinary skill in the art to understand these embodiments and other embodiments involving modifications suited to a particular implementation.

What is claimed is:

1. A method, consisting of:

folding a shaft of the boot against a leg of a person wearing the boot and pants including a pant leg;

wrapping a generally flat strap around the folded shaft of the boot, wherein the strap includes a fabric having an inner side pressing against the boot and an outer side directed away from the boot;

fastening the strap securely around the folded shaft of the boot by pressing a hook patch secured to a first end of the strap against a loop patch secured to a second end of the strap, wherein the fastened strap holds the shaft of the boot in a folded condition; and pulling the pant leg down over the folded shaft of the boot and over the outer side of the fastened strap, wherein the outer side of the strap includes a non-slip material that grips the pant leg and keeps the pant leg in place over the strap when walking or sitting down, and wherein the fastened strap prevents the boot shaft from causing visible deformation of the pant leg that has been pulled down over the fastened strap and folded shaft of the boot.

2. The method of claim 1, wherein the boot shaft is folded about a vertical fold line to lay smooth against the leg.

3. The method of claim 1, wherein the non-slip material is a closed cell foam material.

4. The method of claim 3, wherein the closed cell foam material is formed only on the outer side of the strap.

5. The method of claim 4, wherein the inner side of the elastic fabric strap does not include any of the non-slip material.

6. The method of claim 5, wherein the non-slip material covers the outer side of the elastic strap from the first end of the strap to the second end of the strap.

7. A method, consisting of:

folding a shaft of the boot against a leg of a person wearing the boot and pants including a pant leg;

stretching a generally flat elastic strap around the folded shaft of the boot, wherein the elastic strap includes an elastic fabric having an inner side pressing against the boot and an outer side directed away from the boot;

fastening the elastic strap securely around the folded shaft of the boot by pressing a hook patch secured to a first end of the elastic strap against a loop patch secured to a second end of the elastic strap in a stretched condition, wherein the fastened elastic strap holds the shaft of the boot in a folded condition; and pulling the pant leg down over the folded shaft of the boot and over the outer side of the fastened elastic strap, wherein the outer side of the elastic strap includes a non-slip material that grips the pant leg and keeps the pant leg in place over the fastened elastic strap when walking or sitting down, and wherein the fastened elastic strap prevents the boot shaft from causing visible deformation of the pant leg that has been pulled down over the fastened strap and folded shaft of the boot.

8. The method of claim 7, wherein the non-slip material is a closed cell foam material.

9. The method of claim 8, wherein the closed cell foam material is formed only on the outer side of the strap.

10. The method of claim 9, wherein the inner side of the elastic fabric strap does not include any of the non-slip material.

11. The method of claim 10, wherein the non-slip material covers the outer side of the elastic strap from the first end of the strap to the second end of the strap.

12. The method of claim 3, wherein the closed cell foam material is formed only on the outer side of the strap so that the closed cell foam material does not touch the boot.

13. The method of claim 8, wherein the closed cell foam material is formed only on the outer side of the strap so that the closed cell foam material does not touch the boot.

14. The method of claim 7, wherein the boot shaft is folded about a vertical fold line to lay smooth against the leg.

15. The method of claim 1, wherein the strap has a length between 8 and 20 inches and a width between 2 and 4 inches.

16. The method of claim 7, wherein the strap has a length between 8 and 20 inches and a width between 2 and 4 inches.

* * * * *